US008720118B2

(12) United States Patent
Meyers et al.

(10) Patent No.: US 8,720,118 B2
(45) Date of Patent: May 13, 2014

(54) VEHICLE DOOR TRIM PANEL

(75) Inventors: Gerritt B. Meyers, Ypsilanti, MI (US); Tiffany Beech, Pinckney, MI (US); Jeff Pehler, Ann Arbor, MI (US)

(73) Assignee: Toyota Motor Engineering & Manufacturing North America, Inc., Erlanger, KY (US)

( * ) Notice: Subject to any disclaimer, the term of this patent is extended or adjusted under 35 U.S.C. 154(b) by 11 days.

(21) Appl. No.: 13/443,069

(22) Filed: Apr. 10, 2012

(65) Prior Publication Data

US 2013/0263518 A1 Oct. 10, 2013

(51) Int. Cl.
*E05B 77/04* (2014.01)
*E05B 79/06* (2014.01)
*E05B 65/12* (2006.01)

(52) U.S. Cl.
CPC ..... *E05B 77/04* (2013.01); *E05B 79/06* (2013.01)
USPC ..... 49/503; 49/460

(58) Field of Classification Search
CPC ..... E05B 79/06; E05B 85/12; E05B 77/04; E05B 77/02
USPC ..... 49/460, 502, 503; 292/336.3, DIG. 31, 292/DIG. 65; 296/146.7, 187.05, 187.12; 16/412, 413, 415, 425, DIG. 24
See application file for complete search history.

(56) References Cited

U.S. PATENT DOCUMENTS 4,580,822 A * 4/1986 Fukumoto ..... 292/336.3
4,681,357 A * 7/1987 Uemura et al. ..... 292/336.3
4,892,342 A * 1/1990 Newman et al. ..... 292/347
5,183,302 A * 2/1993 Pelachyk et al. ..... 292/336.3
5,377,450 A 1/1995 Varajon
6,039,366 A * 3/2000 Lewis ..... 292/352
6,059,329 A * 5/2000 Spitzley ..... 292/336.3
6,070,923 A * 6/2000 Tanimoto et al. ..... 292/336.3
6,099,052 A * 8/2000 Spitzley ..... 292/336.3
6,189,267 B1 * 2/2001 Staser ..... 49/503
7,237,411 B2 * 7/2007 Pantke et al. ..... 70/208
7,404,588 B2 * 7/2008 Gabsch et al. ..... 296/146.7
7,562,916 B2 * 7/2009 Cummins et al. ..... 292/336.3
7,661,743 B2 * 2/2010 Williamson et al. ..... 296/50
8,128,151 B2 * 3/2012 Teramoto et al. ..... 296/146.1
8,220,848 B2 * 7/2012 Minemura et al. ..... 292/347
8,282,142 B2 * 10/2012 Fannon ..... 292/336.3
8,387,311 B2 * 3/2013 Heller ..... 49/503
2003/0177796 A1 * 9/2003 Dimig ..... 70/237
2008/0022602 A1 * 1/2008 Senoo ..... 49/502
2013/0088022 A1 * 4/2013 Collado et al. ..... 292/336.3

FOREIGN PATENT DOCUMENTS

JP 2004176478 A 6/2004
JP 2007009478 1/2007

* cited by examiner

*Primary Examiner* — Katherine Mitchell
*Assistant Examiner* — Justin Rephann
(74) *Attorney, Agent, or Firm* — Christopher G. Darrow; Young Basile Hanlon & MacFarlane P.C.

(57) ABSTRACT

The vehicle door construction includes a bezel carrying a door release lever and linkage connected by a pair of first attachments to a door trim panel and by a second attachment to a door inner panel. The pair of first attachments includes a collar with an aperture for receiving a fastener to attach the bezel via the collar to the door trim panel. A small tab integrally connects the collar to a main portion of the bezel and defines a rupturable area when force is exerted on the door causing the door trim panel to separate from the door inner panel. The tabs rupture to allow the door trim panel to separate from the door inner panel while maintaining the bezel and the door release lever and linkage fixedly attached to the door inner panel.

4 Claims, 4 Drawing Sheets

VEHICLE DOOR TRIM PANEL

BACKGROUND

The present invention relates, in general, to vehicle door constructions and more particularly to a vehicle door and a door inner trim panel attachment.

In current vehicle door construction, a steel door inner panel is welded to a steel outer door panel. An inner door trim panel is attached to the inner door panel by screws and/or clips.

A door release lever is mounted in a bezel which is attached to the door inner trim panel by a plurality of screws as well as another screw extending through the bezel into a clip mounted in the door inner panel. The door release lever is coupled to a linkage which is fixed to the door inner panel by the screw extending through the bezel into the clip in the door inner panel. The linkage moves a door release cable attached to the door latch at the rear edge of the door to control opening of the door.

The rear occupant door structure may be within the crush zone during some rear vehicle impact. As the rear door deforms, the inner door trim panel can separate from the rear door and pull the bezel and the attached door release lever from the door inner panel. This separation movement can exert a force on the door release cable causing the cable to trigger the rear door latch to move to an opened position.

It would be desirable to provide a vehicle door construction which maintains the door release lever in fixed engagement with the door inner panel despite any disengagement of the inner door trim panel from the door inner panel during a rear vehicle impact.

SUMMARY

A vehicle door includes a door inner panel, a door trim panel mounted on an interior surface of the inner door panel, a bezel attached to the door trim panel, a door lock release lever and linkage carried by the bezel, a pair of first attachments fixedly attaching the bezel at two locations to the door trim panel, and a second attachment fixedly attaching the bezel to the door inner panel. The pair of first attachments define breakaway portions which breakaway from the bezel to release the bezel from the door trim panel when the door trim panel separates from the door inner panel to maintain the bezel fixedly attached to the door inner panel by the second attachment.

The breakaway portions include a collar having an aperture for receiving one of the pair of first attachments to attach the bezel to the door trim panel, and a tab connecting the collar to a main portion of the bezel. The tab has a smaller cross section, such as a smaller width, than the cross section or width of the collar.

In another aspect, a bezel, for a vehicle door having a door inner panel and an inner door trim panel mounted on an interior surface of a door inner panel, is adapted for carrying a door release lever and door release linkage, a pair of first attachments fixedly attaching the bezel at two locations to the door trim panel, and a second attachment adapted for fixedly attaching the bezel to the door inner panel. The pair of first attachments define breakaway portions on the bezel which breakaway from the bezel to release the bezel from the door trim panel when the door trim panel separates from the door inner panel to maintain the bezel and the attached door release lever, linkage and door release cable fixedly attached to the door inner panel by the second attachment.

BRIEF DESCRIPTION OF THE DRAWING

The various features, advantages and other uses of the present vehicle door trim panel will become more apparent by referring to the following detailed description and drawing in which.

DETAILED DESCRIPTION

Figure 1:
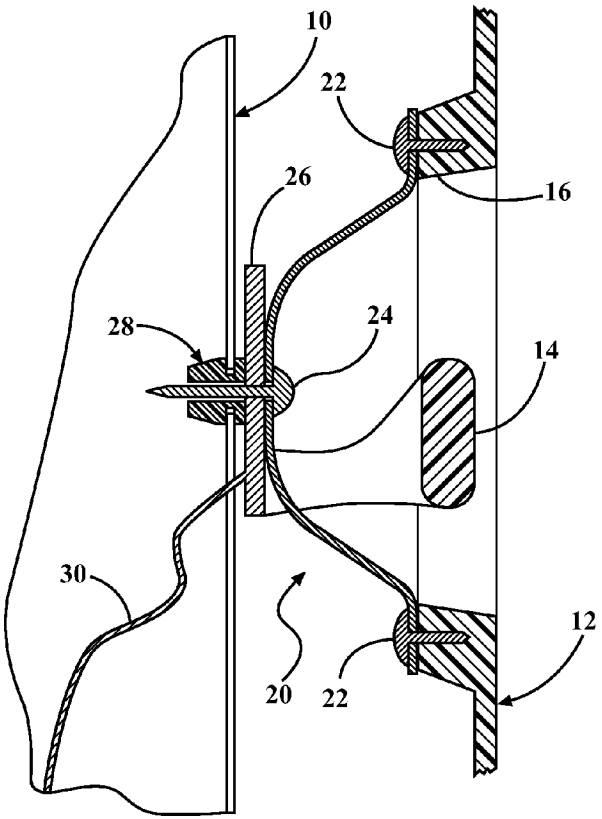
FIG. 1 PRIOR ART
FIG. 1 is a lateral cross-sectional view of a prior art vehicle door construction.

Referring now to FIG. 1, there is depicted a cross-sectional view of prior art vehicle door components. In a typical vehicle door, a door inner panel 10, formed of sheet metal, is welded to a door outer panel, not shown.

An inner door trim panel 12, hereafter "door trim panel" or "trim panel" is attached by one or more fasteners, such as screws, to the door inner panel 10. The door trim panel 12 provides a decorative interior appearance to the door and covers the raw steel construction of the door inner panel 10. At the same, the door inner trim panel 12 carries door components, such as door release lever 14, arm rest, etc.

As shown in FIG. 1, the door trim panel 12 includes a shaped aperture 16. A cup shaped bezel 20 is mounted over the aperture 16 and is attached by a plurality of fasteners, such as a plurality of screws 22, to the trim panel 12 as well as by another fastener, such as screw 24, through an aperture in a door lever assembly linkage 26 to a clip 28 mounted in an aperture in the door inner panel 10.

Figure 5:
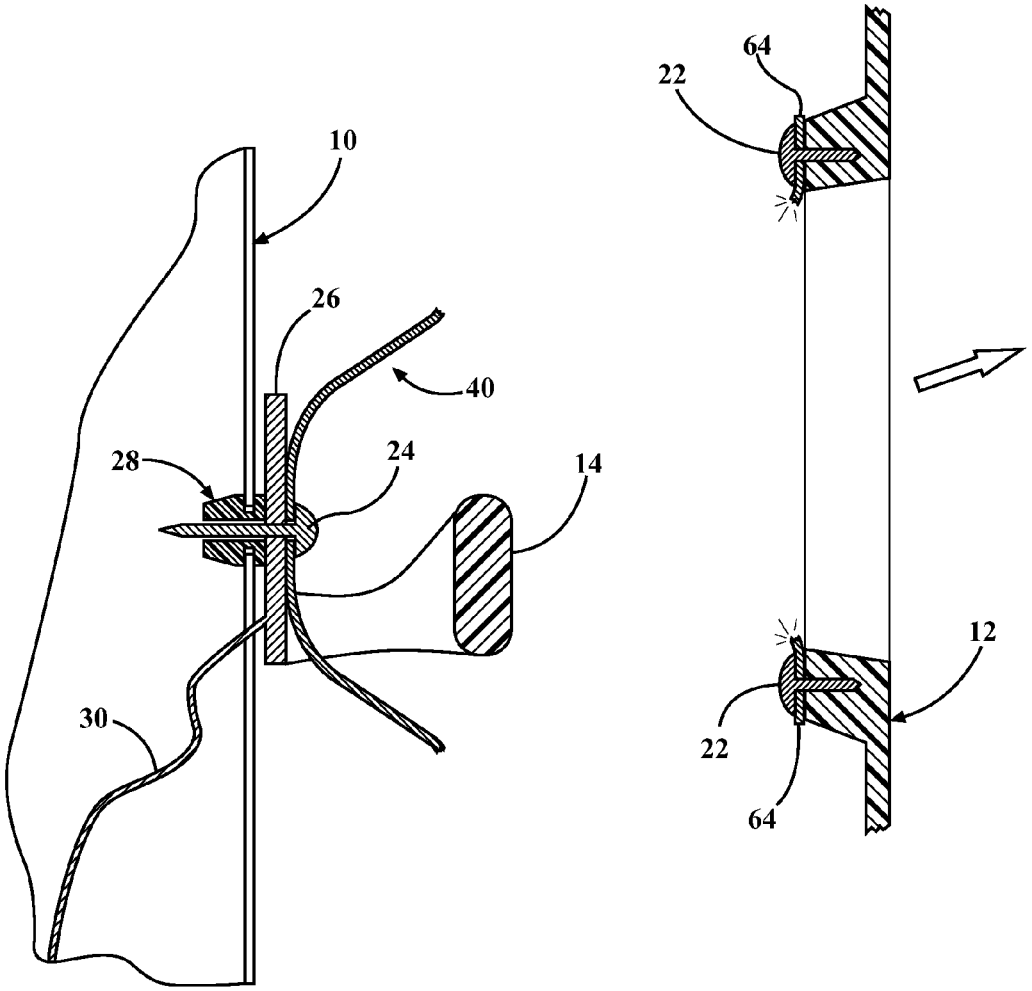
FIG. 5 is a lateral cross-sectional view, of a vehicle door construction, similar to FIG. 2, but showing the position of the door components during a vehicle rear impact.

The door lever linkage 26 acts on movement of the door lever 14 to pivot and exert a force on a door latch release cable 30 extending from the linkage 26 to the rear door latch 60, shown in FIG. 5. The pulling force on the cable 30, when the release lever 14 is moved, causes the rear door latch to unlatch enabling the rear seat occupant to open the rear door.

Figure 2:
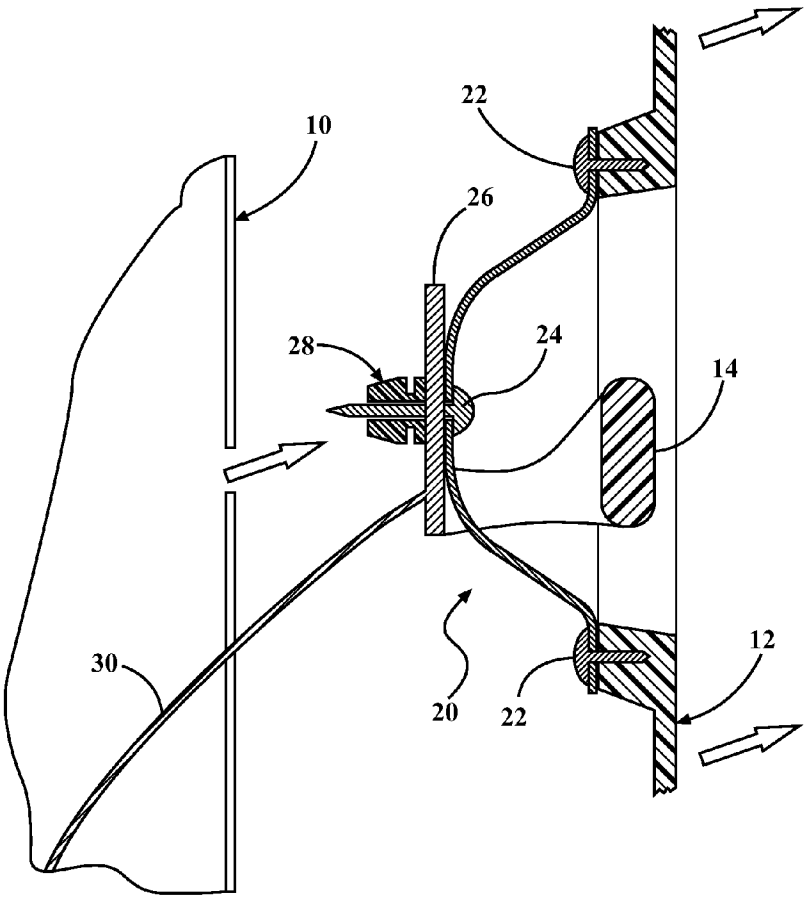
FIG. 2 PRIOR ART
FIG. 2 is a lateral cross-sectional view showing the prior art vehicle door construction of FIG. 1 in a separation state during a rear vehicle impact.

During a rear collision, forces exerted on the vehicle can cause the door trim panel 12 to separate from the door inner panel 10. The secure attachment of the door trim panel 12 to the linkage 26, as shown in FIG. 2, caused the entire linkage assembly 26, the bezel 20, the fastener 24 and clip 28 to disengage from the door inner panel 10. This separation can pull the door release cable 30 into a taught state exerting a force on the rear door latch 60 and potentially causing the rear door latch to unlatch and resulting in an inadvertent opening of the rear door.

Figure 3:
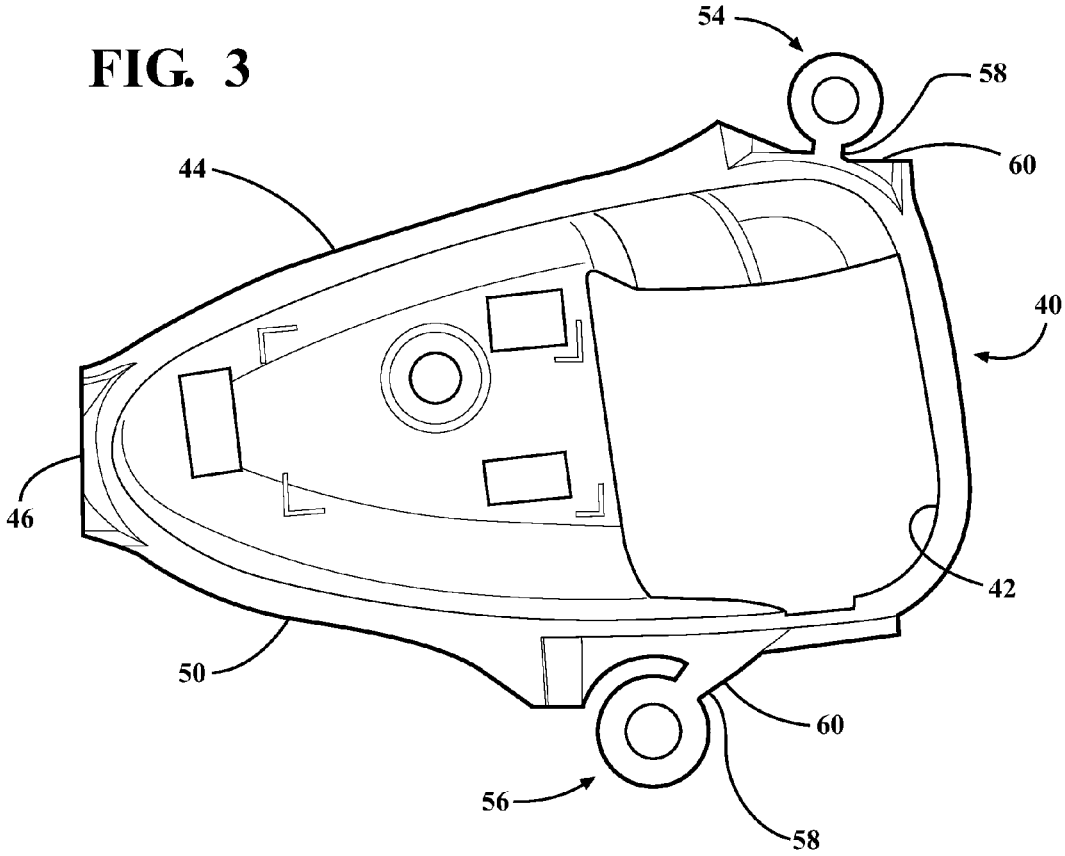
FIG. 3 is a side-elevational view of a new vehicle door bezel attachment.

In FIG. 3, a bezel 40 is depicted with a main portion 44 with a variety of cutouts, including a main cutout or aperture 42 through which a door lever, such the door release lever 14 shown in FIG. 1, protrudes into the vehicle interior.

The main portion 44 of the bezel 40 has a cup-like shape, as also shown in FIG. 1, with a peripheral flange 46 surrounding the main portion 44 of the bezel 40 and engaged with the edges of the door trim panel 12 surrounding the aperture 16 in the door trim panel 12.

Similar to that shown in FIG. 1, the main portion 44 of the bezel 40 sandwiches the door lever assembly linkage 26 between the main portion 44 of the bezel 40 and the adjacent door inner panel 10. An aperture 50 in the main portion 44 of the bezel 40 receives the fastener 24 to attach the bezel 40 and the door trim panel 12 through the clip 28 to the door inner panel 10.

Figure 4:
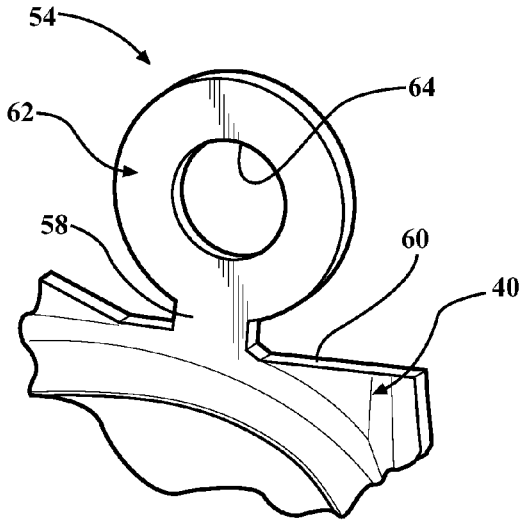
FIG. 4 is an enlarged view of one of the mounting tabs on the bezel shown in FIG. 3.

According to one aspect, at least one weak attachment or connector, with two weak attachments or connectors 54 and 56 shown by example in FIG. 3, is integrally coupled to the bezel 40 and functions as a mount for a fastener to attach the bezel 40 to the door trim panel 12, as shown in FIG. 1. As shown in detail in FIG. 4, each connector 54 and 56 includes a breakaway portion such as a thin stem or tab 58 which integrally extends from an edge 60 of the bezel 40. An enlarged collar 62 is integrally attached to one end of the stem or tab 58, and carries an aperture 64 for receiving the bezel 40 to door trim panel 12 fastener, such as fastener 22 shown in FIG. 1.

Each tab 58 is formed with a smaller cross-section or width than the cross-section or width of the collar 62 to form each tab 58 as a weak break point on the bezel 40. Alternately, the thickness of the tab 58 may also be made smaller than the thickness of the collar 62. Further, each tab 58 can have indented side cutouts or score lines.

With two connectors 54 and 56 used to attach the bezel 40 to the trim panel 12, the door trim panel 12 is securely attached to the bezel 40. Additional clips, not shown, are typically employed around the periphery of the door trim panel 12 to secure the edges of the door trim panel to the door inner panel 10.

The bezel 40 shown in FIG. 3 thus has three attachment points, including the two first attachments 54 and 56 which receive fasteners, such as screws 22, to initially attach the bezel to one surface of the door trim panel 12 as well as a more centrally located, stronger retention force fastener or screw 24 which extends through the aperture 50 in the bezel 40 through a similar aperture in the door lever linkage 26 and into the clip 28 mounted on the door inner panel 10.

The weakened or breakaway portions provided by the tabs 58 on the bezel 40 provide break points which cause the main portion 44 of the bezel 40 to separate from the door trim panel 12 at lower force levels than the force required to separate the fastener 24 and the clip 28 from the door inner panel 10, as shown in the prior art vehicle door construction depicted in FIG. 2.

During a rear vehicle collision which exerts forces on the vehicle door assembly which can cause the door trim panel 12 to move in the direction of the arrows shown in FIG. 2, the tabs 58, due to their lower rupture or break strength that the securing force fixing the adjacent collar 62 by fastener 22 to the door trim panel, ruptures or tears to separate the main portion 44 of the bezel 40 from the door trim panel 12 enabling the door trim panel 12 to move in the direction of the arrows shown in FIG. 2 and separate from the inner door panel 10 while still maintaining the fixed engagement of the main portion of the bezel 40 via the fastener 24 to the door inner panel 10. In this manner, the door release lever 14 remains in a fixed stationary position relative to the door inner panel 10 preventing any movement of the lever 14 and the linkage 26, in the direction shown in the prior art door configuration depicted in FIG. 2 which would exert a force on the door latch release cable 30 possibly causing unlatching of the rear door latch and opening of the rear door.

The combined rupture or break force resistance of the two tabs 58 is less than the attachment force of the fastener 24 such that the tabs 58 rupture to separate the collars 62 and the fasteners 22 extending through the apertures 64 in the collars 62 from the main portion of the bezel 40.

Figure 6:
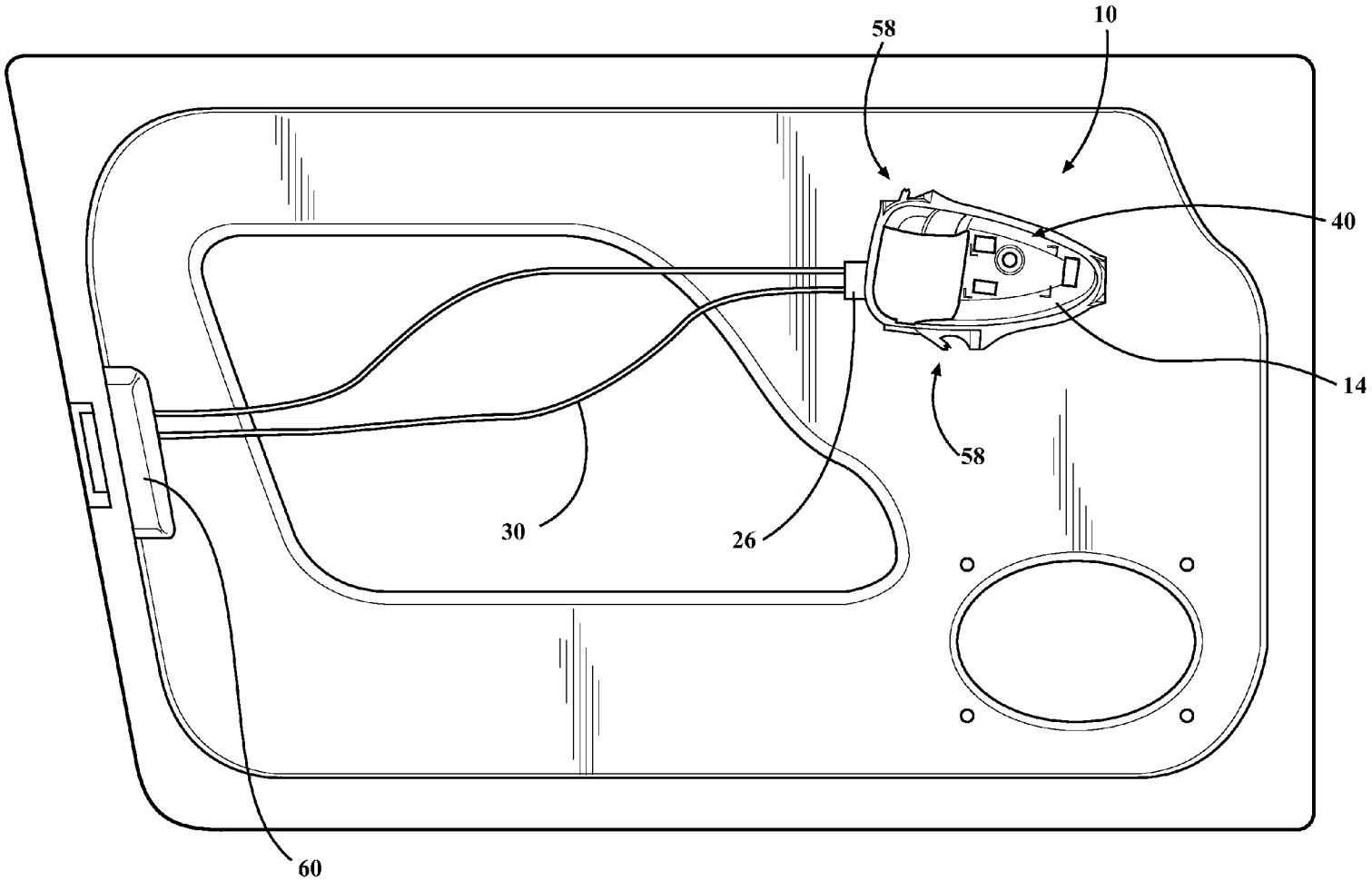
FIG. 6 is a side-elevational view of FIG. 5, but with the door inner panel trim completely disengaged from the door inner panel.

As shown in FIG. 6, after the door trim panel 12 has completely separated from the door inner panel 10, the bezel 40 remains secured in its fixed original position on the door inner panel 10. The release lever cable therefore remains in its original position between the lever linkage 26 and the rear door latch 60 and has not unlatched the rear door latch.

As also shown in FIG. 6, the collars 62 on the bezel 40 are no longer attached to the main portion 44 of the bevel 40 to indicate that the tabs 58 and connection provided by the collars 62 of each connection 54 and 56 remain integrally attached to the door trim panel 12 after the door trim panel 12 has separated from the door inner panel 10.

What is claimed is:

1. A vehicle door comprising:

a door inner panel;

a door trim panel mounted on an interior surface of the door inner panel;

a bezel attached to the door trim panel;

a door lock release lever and a door release linkage carried by a main portion of the bezel;

a plurality of first attachments fixedly attaching the bezel at a plurality of locations to the door trim panel;

a second attachment fixedly attaching the bezel to the door inner panel; and a portion of the plurality of first attachments defining tear away separable portions which tear away from the bezel to release the bezel from the door trim panel when the door trim panel separates from the door inner panel to maintain the bezel fixedly attached to the door inner panel by the second attachment;

each of the plurality of the first attachments including:

a collar having a closed aperture receiving a fastener to attach the bezel via the collar to the door trim panel; and a tab connecting the collar to the bezel, the tab having a smaller lateral cross-section than a lateral cross-section of the collar and defining the tear away separable portions of the first attachment.

2. The vehicle door of claim 1 wherein:

a combined break-away force resistance of the tabs of the plurality of first attachments is less than a securing force of the second attachment to the door inner panel.

3. A bezel for a vehicle door having a door inner panel and an inner door trim panel mounted on an interior surface of the door inner panel, the bezel comprising:

a bezel adapted for carrying a door lock lever and a door unlatch linkage;

a pair of first attachments fixedly attaching the bezel at two locations to the inner door trim panel;

a second attachment fixedly attaching the bezel to the door inner panel; and the pair of first attachments defining tear away separable portions of the bezel which tear away from the bezel to release the bezel from the inner door trim panel when the inner door trim panel separates from the door inner panel to maintain the bezel fixedly attached to the door inner panel by the second attachment;

each of the pair of the first attachment including:

a collar having closed aperture receiving a fastener to attach the bezel via the collar to the inner door trim panel; and a tab connecting the collar to the bezel, the tab having a smaller lateral cross-section than a lateral cross-section of the collar.

4. The bezel of claim 3 wherein:

the combined break-away force resistance of the tabs of the pair of first attachments is less than a securing force of the second attachment to the door inner panel.

* * * * *

UNITED STATES PATENT AND TRADEMARK OFFICE

CERTIFICATE OF CORRECTION

PATENT NO. : 8,720,118 B2
APPLICATION NO. : 13/443069
DATED : May 13, 2014
INVENTOR(S) : Gerritt B. Meyers, Tiffany Beech and Jeff Pehler It is certified that error appears in the above-identified patent and that said Letters Patent is hereby corrected as shown below:

In the Specification

In Column 2, Line No. 58, please delete “taught” and add --taut--.

Signed and Sealed this
Fifth Day of August, 2014

Michelle K. Lee

Michelle K. Lee
*Deputy Director of the United States Patent and Trademark Office*